United States Patent [19]

Powers

[11] 4,148,258

[45] Apr. 10, 1979

[54] FLARE HOLDER APPARATUS

[76] Inventor: David F. Powers, 1240 E. Tuckey La., Phoenix, Ariz. 85014

[21] Appl. No.: 768,158

[22] Filed: Feb. 14, 1977

[51] Int. Cl.[2] ..... F42B 4/26

[52] U.S. Cl. ..... 102/37.4; 248/520

[58] Field of Search ..... 102/37.4, 37.8; 248/520

[56] References Cited

U.S. PATENT DOCUMENTS

| | | | |
|---|---|---|---|
| 2,981,510 | 4/1961 | Burns | 248/520 |
| 3,146,613 | 9/1964 | Hiner | 102/37.4 |
| 3,149,566 | 9/1964 | Klinger | 102/37.4 |
| 3,285,550 | 11/1966 | Smith | 248/520 |
| 3,905,324 | 9/1975 | English | 248/520 |

*Primary Examiner*—Verlin R. Pendegrass
*Attorney, Agent, or Firm*—H. Gordon Shields

[57] ABSTRACT

Consumable flare holder apparatus is disclosed which supports and holds a road flare during the burning of the flare and which is consumed or used without leaving a harmful residue on the road and without leaving a remnant on the road after use which may be hazardous to later vehicular traffic.

10 Claims, 7 Drawing Figures

FLARE HOLDER APPARATUS

BACKGROUND OF THE INVENTION

1. Field of the Invention

This invention relates to flare holders and, more particularly, to a flare holder which is used for holding a flare while the flare is being used on or adjacent a roadway.

2. Description of the Prior Art

There are several types of road flares employed as signal devices. One such flare includes a built-in spike at the bottom end of the flare. The spike is driven into the roadside dirt or into the asphalt road surface and accordingly holds the flare in a generally upright position while the flare is used (burned). When the flare is burned up, the spike, which may or may not be imbedded in, or sticking through, a block of wood, or some other substance, remains in position where the flare was situated. Such flare leaves a remnant or residue which is hazardous to later traffic if not removed from the roadway or from adjacent the roadway and appropriately disposed of. Obviously, during the emergency situation which required the employment of a flare, and during the time after the emergency is under control, such residue or remnant may be, and frequently is, overlooked, thus allowing the hazard to remain.

In more common use is simply a flare without a built-in holder. This type of flare is simply ignited and either held, manually, by a user while it burns, or the flare, after ignition, is simply disposed directly on the roadway. If the flare is placed directly on the roadway, maximum efficiency of the flare is not obtained because the flare is not disposed in an upright position for maximum visibility. Moreover, the burning of the flare produces heat which is directly in contact with the roadway, thus melting or scarring a portion of the roadway.

In such flare is held by hand, obviously the holder of the flare is only able to hold the flare for a period of time which varies with the burning rate of the flare. When the flare is burned to a point where sufficient heat from the flare affects the individual holding the flare, the flare will be simply dropped or placed directly on the roadway, as discussed in the preceding paragraph. Moreover, the individual holding the flare is not available for other duties. Thus several problems are present, the first being the possibility of a burn to either the holder or to his clothes, the second being the potential damage to the roadway, and the third being the limited use of a person for holding the flare.

To overcome the deficiencies of the self-contained spike flare or the naked flare, different types of holders have been suggested. One type holder of the prior art is disclosed in U.S. Pat. No. 3,149,566. This patent describes an expanded polystyrene block which includes provision for holding a flare in a protected environment prior to use and an aperture or recess in the block in which the flare may be disposed during burning. The block is made of self-extinguishing or noncombustible material which simply disintegrates under the action of the heat of the flare. More distinctly, a portion of the block disintegrates as a result of the heat of the flare, and the residue is left on the road. Unless the residue, which may be a sizeable amount of the block, is physically removed from the roadway, the block presents a potential hazard to later traffic on the roadway.

Another holder of the prior art is disclosed in U.S. Pat. No. 3,678,856. A rigid paper-board flare is disclosed which is of a generally rectangular configuration with a pair of apertures located therein. As illustrated, the holes or apertures are used to hold flares in various orientations, such as with the flare extending generally upwardly, with the flare extending generally horizontal, or with a pair of flares, one generally horizontally and the other at a slight angle. In the latter configuration, the flare disposed generally horizontally is initially lit, and when it burns down the heat from the flare will ignite the other flare. The holder will not hold the flare in and of itself, but rather utilizes the flare as part of the holder to position the flare. Depending on the particular orientation of the flare with respect to the holder, the holder may collapse when only a portion of the flare has been used. On the other hand, the flare is, for all practical purposes, disposed directly on the ground in a generally horizontal disposition.

The preferred situation is to orient a flare upwardly at an appropriate angle for maximum visibility and to minimize the direct exposure of the flare to the roadway on which the flare is disposed. At the same time, a flare holder should preferably be relatively inexpensive to manufacture, compact for storage, and inexpensive to mass produce.

SUMMARY OF THE INVENTION

The invention described and claimed herein comprises a holder for flares which includes a generally flat, planar portion disposed on the ground or roadway, an upwardly inclined portion to which the flare is secured and which supports the flare for maximum visibility of the flare, and a back plate to support the inclined portion of the flare holder. The flare holder is not flammable, yet it will self destruct under the heat produced by the flare.

Among the objects of the present invention are the following:

- To produce a new and useful flare holder;
- To produce a new and useful flare holder which is inexpensive to make;
- To provide a new and useful flare holder which will self destruct with the heat generated by the flare; and
- To provide a new and useful flare holder for supporting a flare above a roadway.

DESCRIPTION OF THE PREFERRED EMBODIMENT

Figure 1:
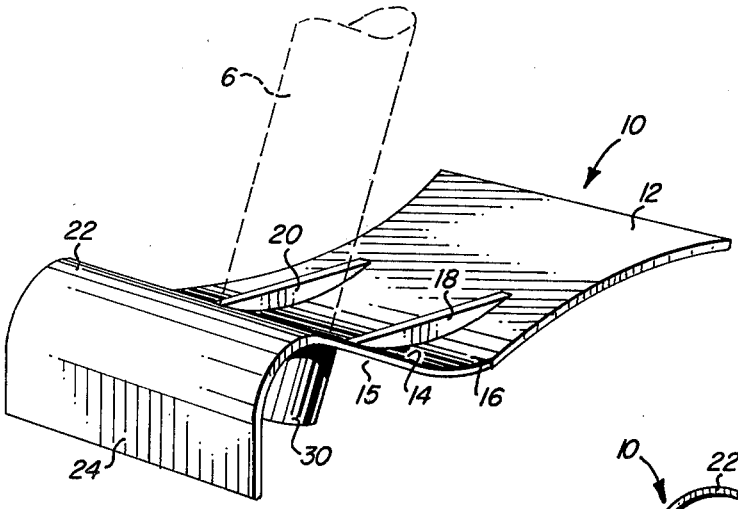
FIG. 1 is a perspective view of flare holder apparatus of the present invention.

FIG. 1 is a perspective view of flare holder apparatus 10 embodying the present invention. It includes a front plate 12, which is substantially flat or planar and is designated to be disposed on a generally flat surface, such as the surface or bed of a road. Extending upwardly from the front plate 12 is an intermediate portion 14 which is also generally flat, but is disposed at an angle of about 135 degrees to the front plate 12. A gently curved connecting portion 16 extends between the front plate 12 and the intermediate plate 14. A pair of ribs or gussets 18 and 20 are shown extending between the front plate 12 and the intermediate plate 14 and the curved connecting portion 16. The stiffening ribs supply strength to the flare holder 10 at the curved connection.

The intermediate plate 14 is secured to a back plate 24 by a top curved portion 22. The back 24 is substantially flat and extends the full width of the holder. The back 24 is substantially perpendicular to the surface on which the apparatus is disposed. The top curved portion 22 is gently rounded and it comprises a transition and spacer from the intermediate plate 14 to the back plate 24. The bottom of the back plate 24, when the apparatus is disposed on a flat surface, such as a road bed (see FIG. 3), is generally in the same plane as the bottom of the front plate 12. The intermediate plate 14 includes a bottom surface 15, and a cylindrical holder cup 30 extends downwardly substantially perpendicular to the bottom surface 15 and accordingly perpendicular to the intermediate plate 14. The holder cup comprises a receptacle into which is disposed a flare, such as shown in phantom in FIG. 1 and identified by reference numeral 6. The lowermost portion of the cylindrical cup 30 is also disposed in a plane that includes the bottom surface of the front plate 12 and the lower surface of the back plate 24. Accordingly, when a flare is disposed in the holder cup 30, it is in part resting against the surface on which the flare holder apparatus is disposed.

Figure 2:
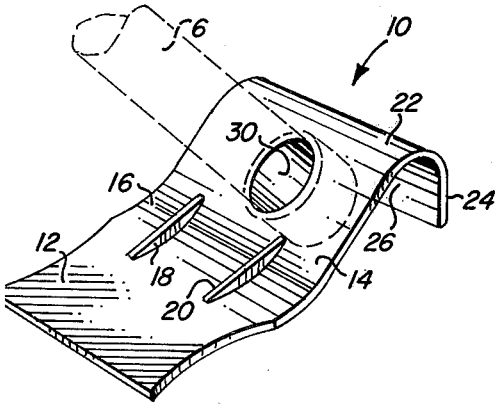
FIG. 2 is a perspective view of the apparatus of FIG. 1 taken from the front and side of the apparatus.

FIG. 2 is a perspective view of the apparatus of FIG. 1, but looking at the apparatus of FIG. 1 from a different direction, namely from the front rather than from the rear, as in the case of FIG. 1. The flare holder apparatus 10 is shown with the flare 6 outlined in phantom disposed within the cylindrical holder cup 30 and projecting upwardly from the intermediate plate or portion 14 of the apparatus, and disposed at substantially a ninety degree angle, or perpendicular, to the intermediate portion 14. The apparatus is placed with the flare and the front plate 12 facing oncoming traffic.

The ribs 18 and 20 are clearly shown in FIG. 2. The ribs are secured to the upper or top surface of the front plate 12, the curved connecting portion 16, and the intermediate portion or plate 14. The ribs or gussets provide appropriate structural support for the flare holder apparatus in the curved transition portion 16 of the apparatus. The advisability of strengthening the apparatus depends on the thickness of the material out of which the flare holder is made. If the plastic material is sufficiently thick to provide inherent structural strength in that area, then the strengthening ribs may be omitted. On the other hand, if the material is relatively thin, so as to reduce both the cost of manufacture and weight, it may be deemed advisable to include ribs.

With the flare 6 disposed at substantially a ninety degree angle, or perpendicular, to the intermediate portion 14, and with the intermediate portion 14 disposed at about a forty-five degree angle to the front portion or plate 12, it follows that the flare is disposed at about a forty-five degree angle to the front plate 12, and overlying a portion of it. Accordingly, the length of the front plate 12 must be correlated with respect to the maximum expected length of the flare 6 so as to provide a sufficient overall length of the apparatus to prevent the apparatus 10 and the flare from tipping over. Obviously, as the flare burns, there is less moment force acting on the apparatus to cause the apparatus to tip.

Figure 3:
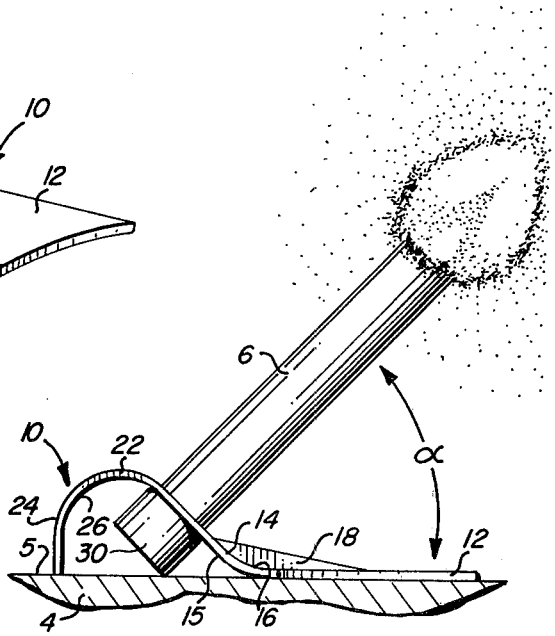
FIG. 3 is a side view of the apparatus of FIGS. 1 and 2.

FIG. 3 is a side view of the flare holder apparatus 10 of FIGS. 1 and 2. The flare holder apparatus 10 is shown with a flare 6 extending upwardly at an angle alpha of about forty-five degrees to the plane of the front plate 12. The apparatus 10 is disposed on a relatively flat surface of a road 4, with the front portion or plate 12 disposed parallel to the surface of the road, or flat on the road, and with the back portion 24 of the apparatus 10 extending upwardly from the surface of the road at about a ninety degree angle thereto, or substantially perpendicular, with the bottom of the back portion on the road.

The flare holder cup 30 is shown extending downwardly and rearwardly from the intermediate portion 14 to the surface 5 of the road. Preferably, the upper portion of the cup 30 is generally flush with the intermediate portion 14 so as not to extend beyond the top surface of the intermediate portion.

A rib or gusset 18 is shown extending between the front portion 12 and the intermediate portion 14. The top portion 22 of the flare holder 10 is shown extending in a gentle, smooth curve between the intermediate portion 14 and the back 24.

As clearly shown in FIG. 3, the cup 30 is disposed in a generally concave hollow 26 defined between the intermediate portion 14, the top portion 22, and the back portion 24. The cup extends downwardly from the back 15 of the intermediate portion 14.

The flare 6 is shown illustratively in a lighted state, and preferably is facing the direction of the oncoming traffic in order to obtain maximum benefit from the flare.

Figure 4:
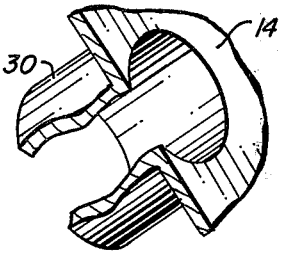
FIG. 4 is a perspective view of a portion of the apparatus of FIG. 1 with a section thereof removed.

FIG. 4 comprises a perspective view of a portion of the apparatus of FIG. 1, with a portion of the apparatus removed to illustrate details of cup 30. The cup 30 is shown against a background of the intermediate plate 14 to which it is secured. The cup 30 is shown as a cylinder open at both ends. The top or upper portion of the cylinder is generally flush with the top surface of the intermediate portion 14 of the holder apparatus 10. The length of the cylinder, axially, is configured so that the bottom portion of the cylinder rests on the surface of the road or pavement on which the apparatus is disposed, as indicated in FIG. 3. There is no bottom portion to the cylinder 30 illustrated in FIG. 4. Rather, the flare itself extends through the cylinder and fills the cylindrical holder cup.

Figure 5:
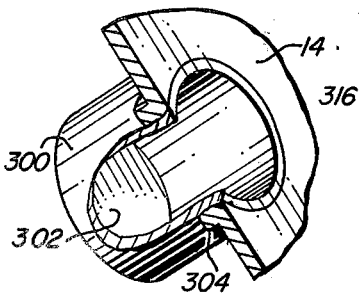
FIG. 5 is a perspective view of an alternate embodiment of the apparatus of FIG. 5.

FIG. 5 is a perspective view of an alternate embodiment of the apparatus of FIG. 4, which comprises a closed cup 300. The cup 300 is shown in the environment of the intermediate portion 14 of the holder apparatus 10, illustrated in FIGS. 1–3, such that the upper portion or top of the cylinder cup 300 is flush with the upper surface of the intermediate portion 14.

A portion of the cylinder wall of the cup 300 is broken away to disclose a bottom 302. While the cylinder cup 30 of FIG. 4 is shown as being an open cup without a bottom, the cylinder cup 300 is shown with a closed bottom 302. A flare is simply inserted into the cup 300 and moved downwardly within the cup until the bottom of the flare rests against the bottom 302. With the bottom of the flare disposed against the bottom 302 of the cup, there is a positive stop engagement between the holder apparatus 10 and the flare (such as flare 6 as indicated by outline in FIGS. 1 and 2, and as shown in FIG. 3).

Some flares include a cap which protects the "starter" material on the top or upper end of a flare and which cap also includes a frictional material or other element secured to the cap which is used to ignite the flare by friction, such as rubbing. In use, the cap is removed from the top of the flare, and the starter material from the top or head of the flare is rubbed on a corresponding portion of the cap to light the flare. This obviates the need for matches or an independent source of flame or heat to ignite the flare. In such situations, the cap may also be used as a cylindrical cup or holder for the flare. In the embodiment of FIG. 5, the cup 300 may be such protective cap and may be used as a cylinder cup by inserting the cup or cap into an aperture or hole 316 in the intermediate portion 114 of the apparatus 110.

Figure 7:
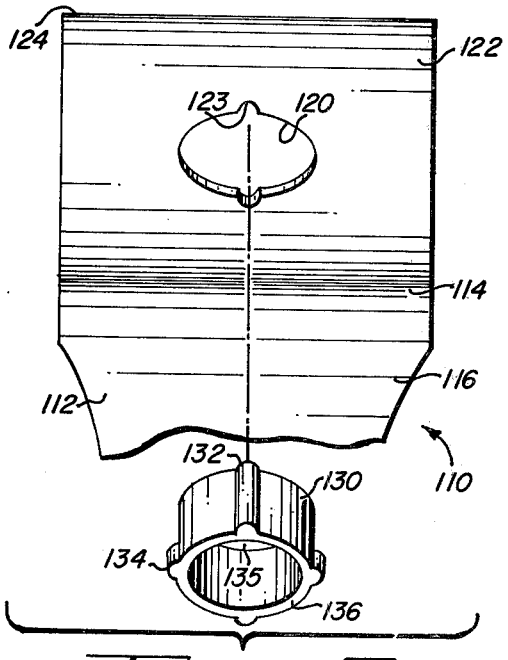
FIG. 7 is a partially exploded front view of a portion of an alternate embodiment of the apparatus of the present invention.

A collar 304 is shown extending about the cylinder 300 beneath the intermediate portion 14. If cup 300, which is shown as a smooth cylinder, comprises the cap for a flare, it may be preferable to include a reinforcing ring or collar 304 disposed beneath the intermediate portion 14 and about the aperture 316 which receives the cap 300 to cause the cap to become a cup to receive the flare. In the embodiment of FIG. 7, the cap or cup 130 includes ribs and stops which align and limit the cup with respect to the holder 110. However, if the cap, which becomes a cup, does not include ribs or limit stops, then a reinforcing collar may be helpful in keeping the cup aligned and disposed properly with respect to the intermediate portion 14. In this way, there is positive holding between the cup and the holder apparatus. If the cup 300 is fabricated or molded as an integral part of the apparatus, the collar may be omitted, and the aperture 216 becomes nonexistent or is in fact simply moved inwardly to define the entrance to the cup.

Figure 6:
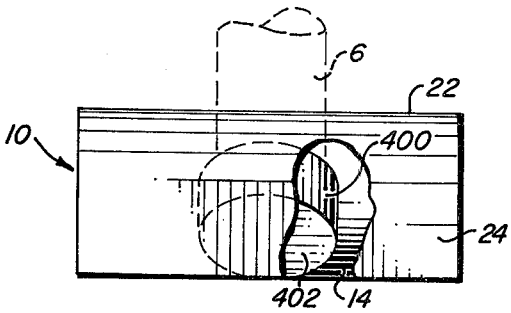
FIG. 6 is a back view of an alternate embodiment of the apparatus of the present invention with a portion of the apparatus broken away.

FIG. 6 is a rear view of apparatus, similar to that of FIGS. 1 and 5, showing a cylindrical cup 400 as an integral part of holder apparatus 10, and with a closed bottom to the cylindrical cup 400. The holder apparatus 10 of FIG. 6 includes a back 24, the top portion 22, and, through the broken-away portion of the back 24, the intermediate portion 14 to which the cup 400 is secured. The bottom 402 is shown disposed at the lower portion of, and closing, the cylinder 400.

An alternate embodiment of the apparatus of FIGS. 1–3 and 5 is shown in FIG. 7. FIG. 7 comprises a partially exploded front view of an alternate embodiment of the apparatus of the present invention.

A holder 110 is shown, which includes a front plate or portion 112, an intermediate portion 114, with a curved connecting portion 116 between the front and the intermediate portions, and a top portion 122. The apparatus also includes a back portion 124 which is shown through an aperture 120 in the intermediate portion 114. The aperture 120 includes a pair of diametrically opposite relieved portions or cutouts 123. The relieved portions or cutouts are for indexing or receiving a separate cup element 130, shown spaced apart from the holder 110. In the embodiment of FIG. 7, the cup 130 is not an integral part of the holder apparatus 110, as is the cup 30 in the holder embodiment of FIGS. 1–3, but comprises a cap for the top of the flare used as a holder cup for the flare, similar to the cup 300 of FIG. 5, and as discussed generally in conjunction with FIG. 5.

For orienting the cup 130 in the aperture 120, the cup 130 includes the pair of diametrically oppositely disposed and axially extending ribs 132 located on the outer periphery of the cup 130 and running axially of the cup. The exterior ribs 132 are received by the relieved portions 123. Extending between the ribs 132, and also oppositely or diametrically opposed on the exterior of the cup 130 are a pair of stops 134. The stops 134 comprise short ribs, similar to the ribs 132, but they extend for only a short distance downwardly from the top or upper surface 136 of the cup 130. With the cup 130 fitted into the aperture 120, the ribs 132 extend into the relieved portions 122 to guide the cup through the intermediate portion 114. The stops 134 accordingly will stop the cup when the stops are resting on the intermediate portion 114. The cup is then relatively substantially secured to the holder apparatus 110. The upper portion of the cup 130, comprising the portion which includes the stops 134, extends above the top surface of the intermediate portion 114.

The cup 130 includes a bottom portion 135, which comprises the top or protective head when the cup is secured to a flare as a cap. The flare, when inserted into the cup 130, is disposed against the interior of the bottom portion 135.

The flare apparatus disclosed herein is made of a combustible or consummable material which melts or is consumed as the flare 6, shown in FIG. 3, burns down to the holder apparatus 10. Accordingly, the flare holder residue left on the roadway presents no problem to traffic and is not a hazard to tires or to following vehicles if a portion of the apparatus were picked up and thrown by a wheel of a moving vehicle. Moreover, the apparatus is inexpensive to manufacture and is readily stored. The apparatus may be stacked for compact storage. In the apparatus of FIG. 7, particularly, when a holder cup is inserted into the apparatus from a flare, the apparatus is conveniently stackable without the impairment of a permanent cup to act as a spacer between adjacent apparatus in a stack. If a cup does not include limit stops and guides, such as in the embodiment of FIG. 7, a reinforcing grommet or collar such as illustrated in FIG. 4 may be made integral with the holder apparatus to receive a cup. The flare holder apparatus of the present invention may be fabricated of such material as vinyl plastics, polyurethane, compressed paper products, thermoplastic resins such as high density polyethylene, and the like. All of such materials will self-destruct with heat, and any residue remaining on a roadway will present no hazard to normal traffic. For non-highway applications, where a reusable flare holder is desirable, the flare holder may be made of ferrous or non-ferrous materials or any synthetic, non-combustible material with a melting point higher than the burning point of the flare material.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and rules promulgated under the authority thereof.

What is claimed is:

1. Flare holder apparatus, comprising, in combination:

a generally flat front plate;

intermediate plate means extending upwardly from the front plate and comprising a continuation of the front plate;

holder means secured to the intermediate plate means for holding a flare at an acute angle with respect to the front plate;

a back plate secured to the intermediate plate means and terminating in substantially the same plane as and remote from the front plate.

2. The apparatus of claim 1 in which the intermediate plate means includes a planar portion disposed at an obtuse angle to the front plate and the intermediate plate means is disposed between the front plate and the back plate.

3. The apparatus of claim 2 in which the intermediate plate means further includes a flat curved transition portion between the planar portion and the back plate.

4. The apparatus of claim 3 in which the holder means is disposed in the planar portion of the intermediate plate means.

5. The apparatus of claim 4 in which the holder means comprises a cup extending downwardly from the intermediate plate means and disposed substantially perpendicular thereto for holding a flare at substantially a forty-five degree angle and overlying a portion of the front plate.

6. The apparatus of claim 5 in which the intermediate plate means includes a second curved transition portion between the front plate and the planar portion.

7. The apparatus of claim 4 in which the holder means includes an aperture extending through the planar portion of the intermediate plate means for receiving a cup to hold a flare.

8. The apparatus of claim 7 in which the holder means further includes a relieved portion for guiding the cup into the aperture.

9. The apparatus of claim 7 in which the holder means further includes a collar disposed about the aperture for holding the cup in the aperture.

10. The apparatus of claim 6 in which the intermediate plate means further includes means for reinforcing the second curved transition portion between the front plate and the planar portion.

* * * * *